US007626147B2

(12) United States Patent
Lee et al.

(10) Patent No.: US 7,626,147 B2
(45) Date of Patent: Dec. 1, 2009

(54) HEATING BODY

(75) Inventors: Young Jun Lee, Seoul (KR); Yang Kyeong Kim, Boocheon-si (KR)

(73) Assignee: LG Electronics Inc., Seoul (KR)

( * ) Notice: Subject to any disclaimer, the term of this patent is extended or adjusted under 35 U.S.C. 154(b) by 342 days.

(21) Appl. No.: 11/457,296

(22) Filed: Jul. 13, 2006

(65) Prior Publication Data

US 2007/0034620 A1 Feb. 15, 2007

(30) Foreign Application Priority Data

Jul. 14, 2005 (KR) ..... 10-2005-0063729

(51) Int. Cl.
*H05B 3/10* (2006.01)
*H01C 10/16* (2006.01)

(52) U.S. Cl. ..... 219/548; 219/494; 219/553; 219/534; 219/200; 338/316; 392/407; 392/411; 392/412; 392/414; 392/415

(58) Field of Classification Search ..... 219/494, 219/553, 534, 548, 200; 338/316; 392/407, 392/411–415
See application file for complete search history.

(56) References Cited

U.S. PATENT DOCUMENTS 4,041,438 A * 8/1977 Landeroin Duvernois ... 338/237
6,980,734 B2 * 12/2005 Halpin ..... 392/407

FOREIGN PATENT DOCUMENTS

CN 2710302 Y 7/2005
DE 1615498 A1 7/1970

OTHER PUBLICATIONS

U.S. Appl. No. 11/457,274, to Lee et al., filed Jul. 13, 2006.
U.S. Appl. No. 11/457,254, to Lee et al., filed Jul. 13, 2006.

* cited by examiner

*Primary Examiner*—Shawntina Fuqua
(74) *Attorney, Agent, or Firm*—McKenna Long & Aldridge LLP

(57) ABSTRACT

A heating body is provided. The heating body includes a tube, a heating member disposed in the tube, and a supporting unit disposed along a length of the tube to maintain a predetermined space between the tube and the heating member.

14 Claims, 7 Drawing Sheets

【 Figure 1】
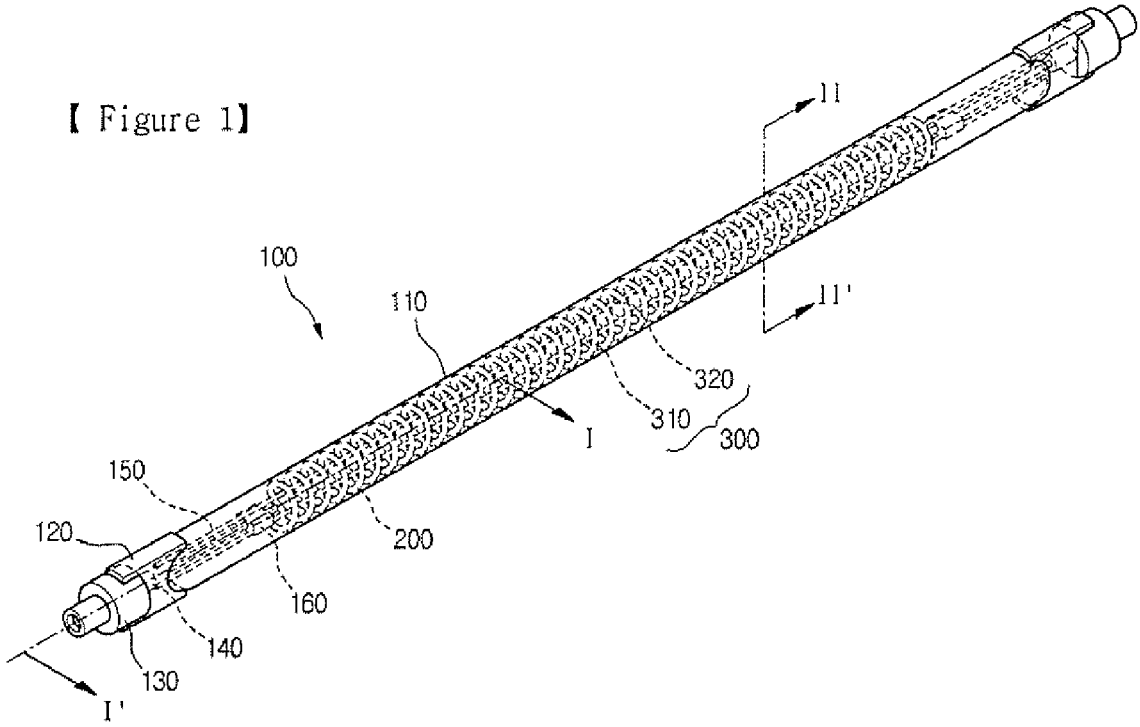

【 Figure 2】
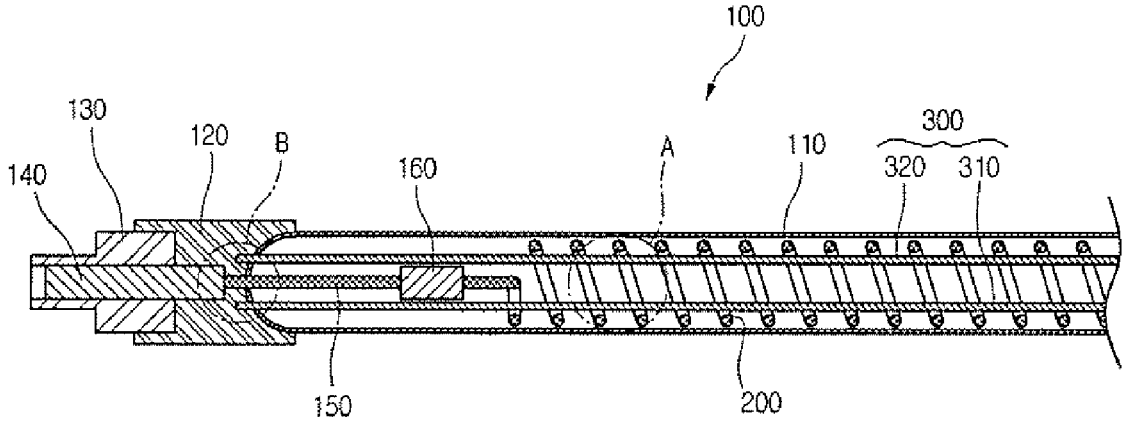

【 Figure 3】
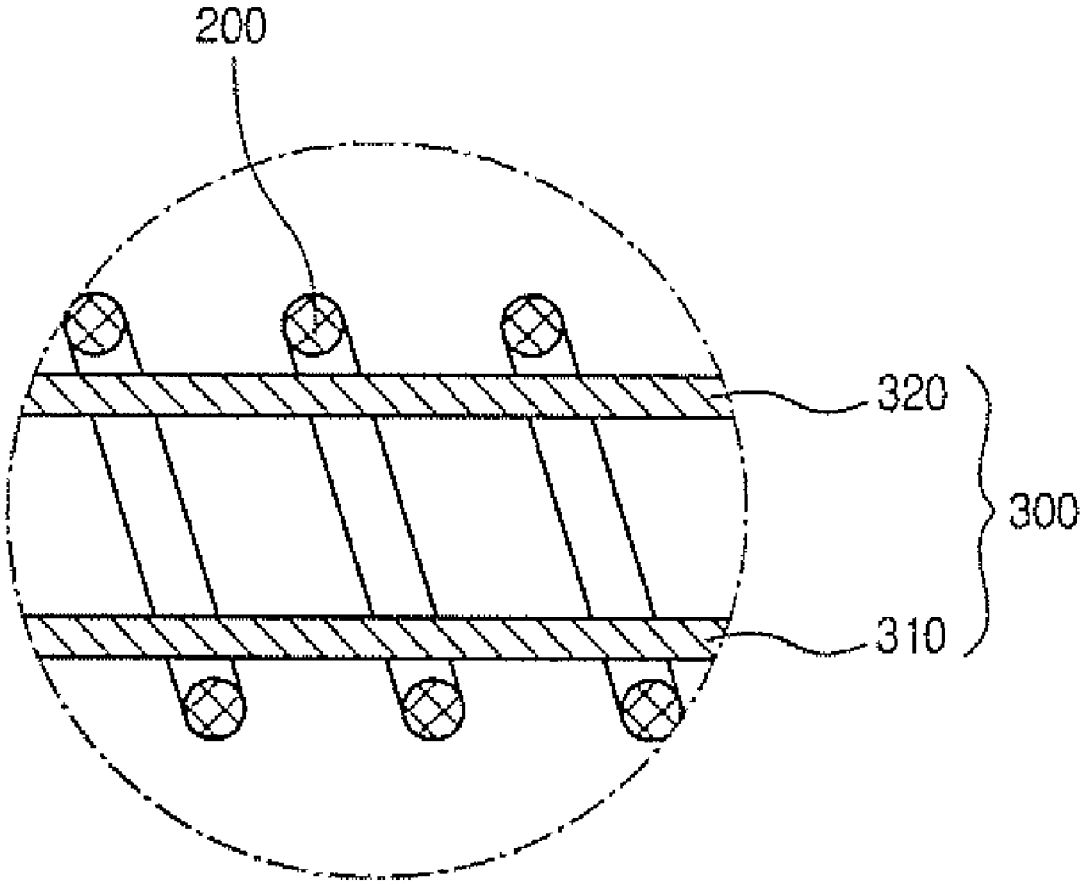

【 Figure 4】
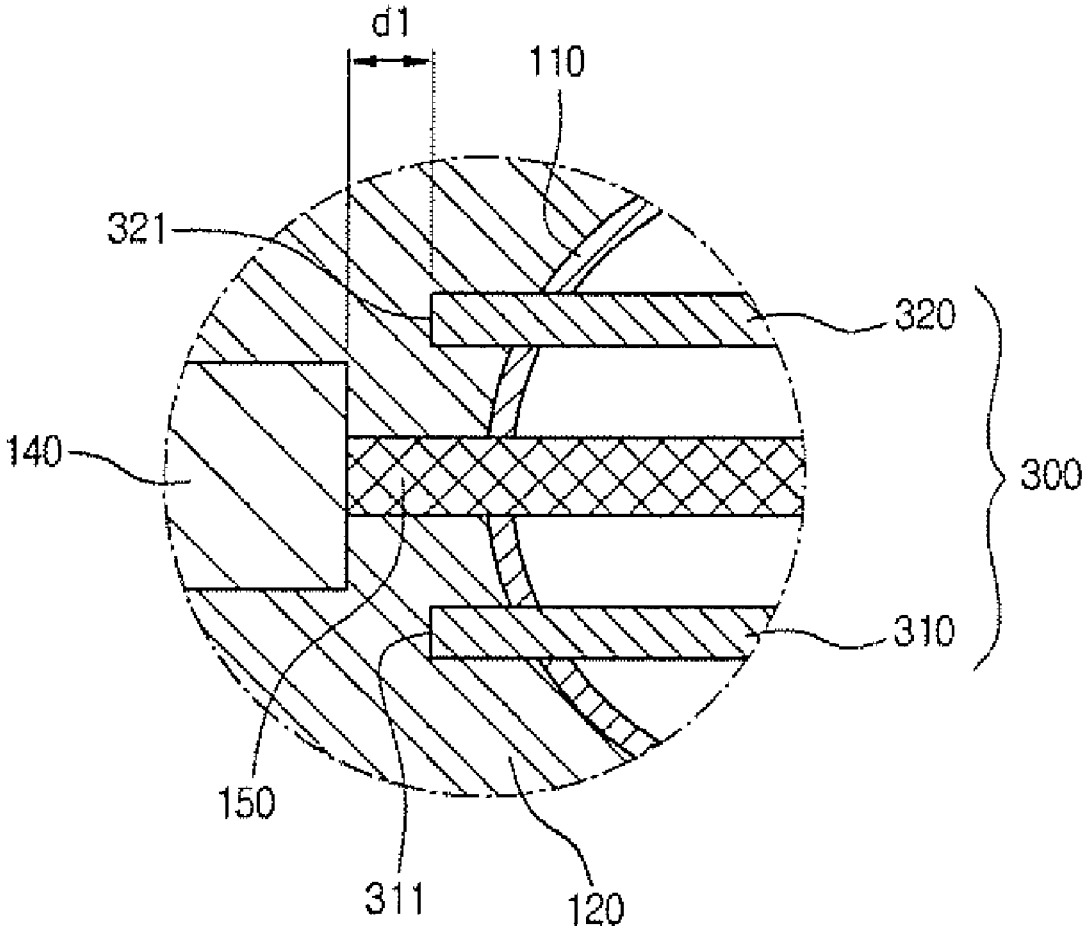

【 Figure 5】
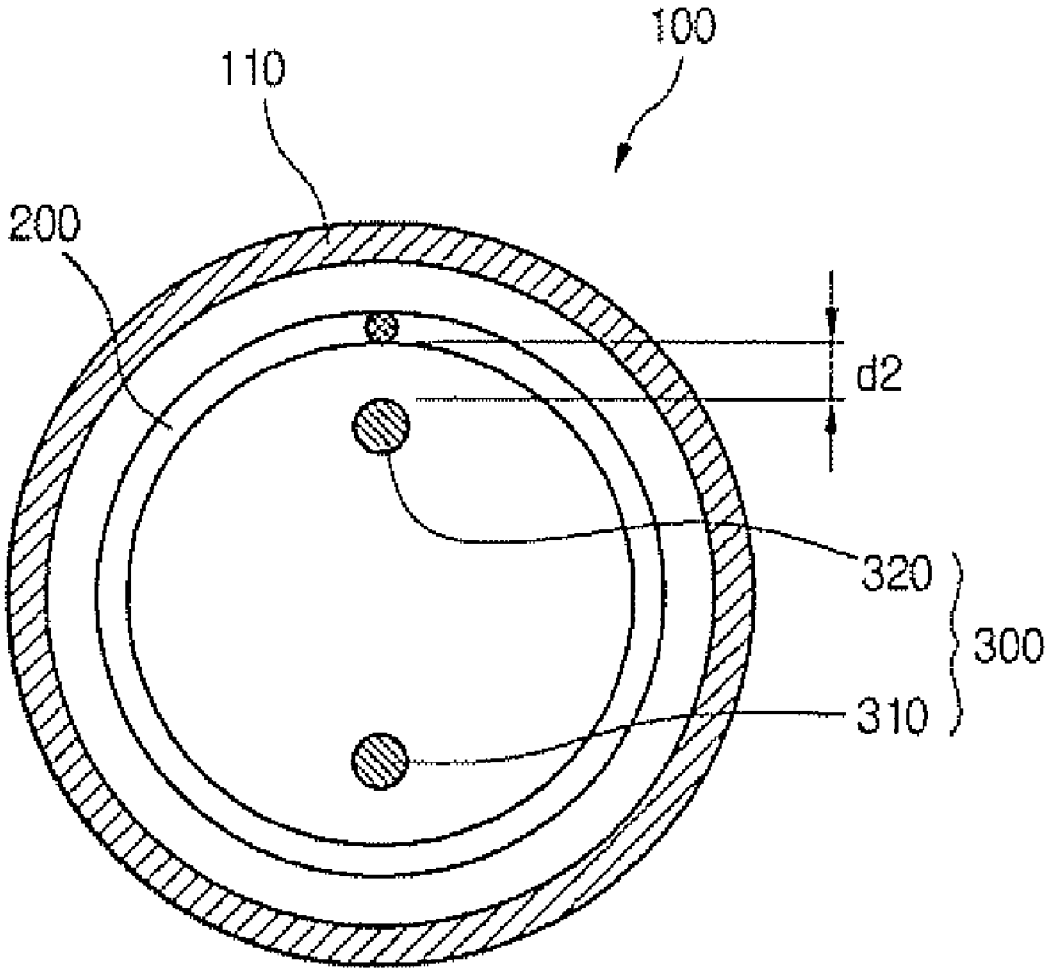

【 Figure 6】
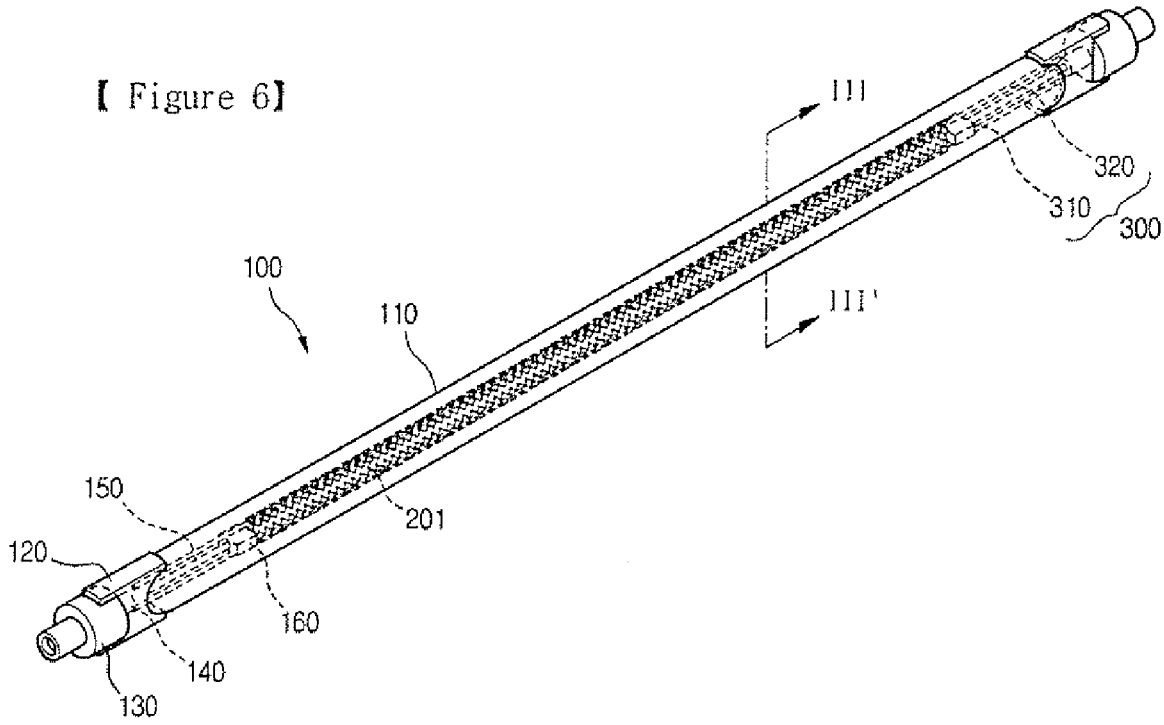

【Figure 7】
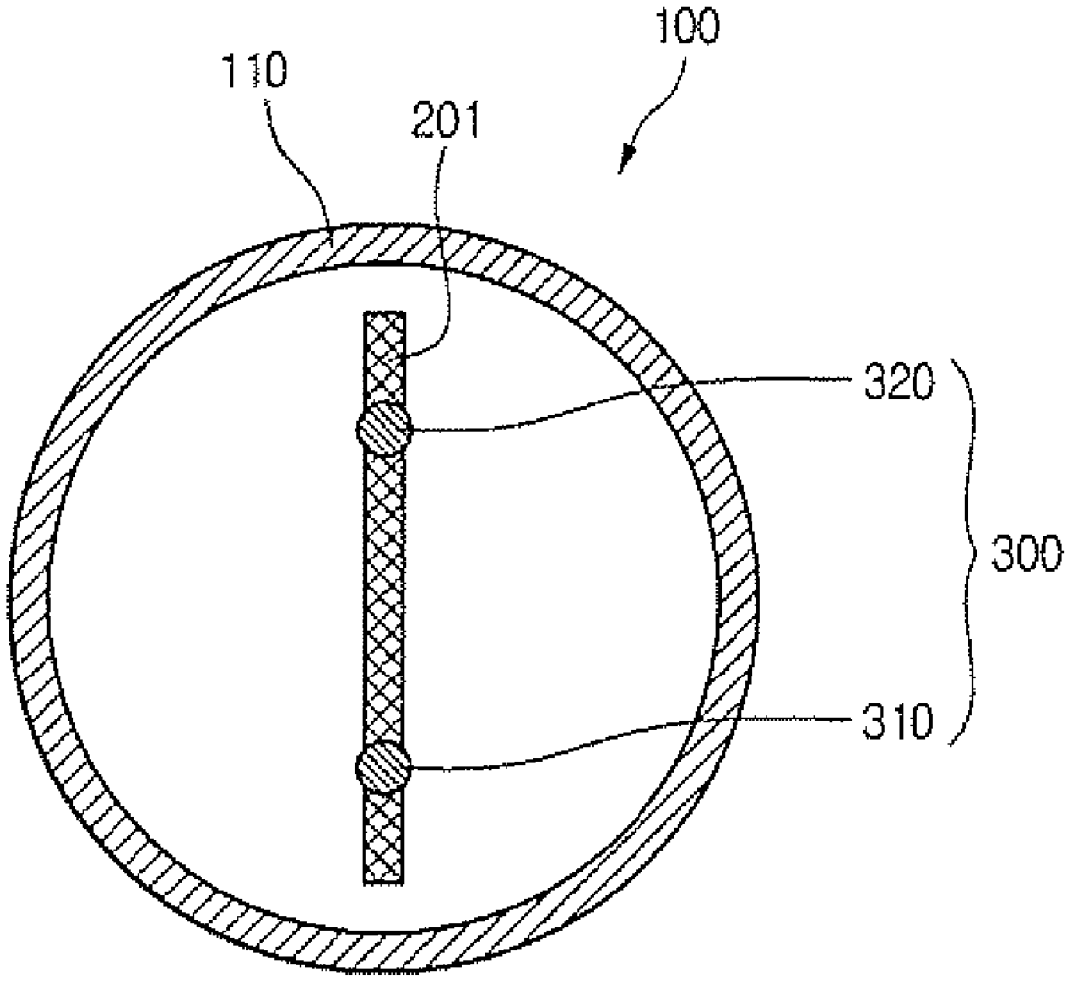

HEATING BODY

BACKGROUND OF THE INVENTION

1. Field of the Invention

The present invention relates to a heating body, and more particularly, to a heating body that can emit heat by converting predetermined energy into heat energy.

2. Description of the Related Art

Generally, a heating body is a device for converting electric energy into heat energy. A conventional heating body includes a filament that is a heating element, a quartz tube in which the filament is inserted, and a connection unit for connecting the filament to an external power source.

That is, the filament formed of a carbon material is inserted in the quartz tube and the quartz tube is sealed. The filament is connected to the external power source by the connection unit. The quartz tube is filled with inert gas such as vacuum gas or halogen gas so as to prevent the filament from be oxidized when the filament emits high temperature heat and thus increase the service life of the heating body.

Meanwhile, the carbon filament is formed in a spiral shape, a plate shape, a linear shape, or the like. The carbon filament may be connected an electrode by a clip or a spring providing a tension. Therefore, the filament is disposed in the quartz tube without contacting an inner surface of the quartz tube. The quartz tube is molten or broken at a temperature above 800° C. Therefore, when the carbon filament emitting heat contacts the inner surface of the quartz tube, the quartz tube may be damaged and thus the service life of the heating body is reduced. Therefore, the carbon filament is supported in the quartz tube by the clip or spring without directly contacting the inner surface of the quartz tube.

That is, in the conventional heat body, the carbon filament is tensioned by outer force not to contact the inner surface of the quartz tube. However, when the carbon filament emits high temperature heat, the carbon filament expands according to its thermal expansion coefficient. When the carbon filament expands, it may physically contact the inner surface of the quartz tube, thereby damaging the quartz tube and reducing the service life of the heating body.

SUMMARY OF THE INVENTION

Accordingly, the present invention is directed to a heating body that substantially obviates one or more problems due to limitations and disadvantages of the related art.

An object of the present invention is to provide a heating body that can prevent a heating member from contacting a tube enclosing the heating member.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a heating body including: a tube; a heating member disposed in the tube; and a supporting unit disposed along a length of the tube to maintain a predetermined space between the tube and the heating member.

In another aspect of the present invention, there is provided a heating body including: a tube; a heating member disposed in the tube; and a supporting unit supporting the heating member along a length of the heating member to maintain a space between the tube and the heating member.

In still another aspect of the present invention, there is provided a heating body including: a tube; a heating member disposed in the tube; a supporting unit disposed across the tube to maintain a space between the tube and the heating member; and a sealing member formed on an end of the tube to fix an end of the supporting unit.

According to the present invention, since the heating member is supported by the heating unit, the contact of the heating member with the tube can be prevented even when the heating member droops due to the thermal expansion during the heat emission. As a result, the damage of the heating member and the tube can be prevented, thereby increasing the life cycle of the heating body.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings:

FIG. 1 is a perspective view of a heating body to an embodiment of the present invention;

FIG. 2 is a sectional view taken along line I-I' of FIG. 1;

FIG. 3 is an enlarged view of a portion A of FIG. 2;

FIG. 4 is an enlarged view of a portion B of FIG. 2;

FIG. 5 is a sectional view taken along line II-II' of FIG. 1;

FIG. 6 is a perspective view of a heating body according to another embodiment of the present invention; and FIG. 7 is a sectional view taken along line III-III' of FIG. 6.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts. While this invention is described with reference to preferred embodiments thereof, it will be understood by those skilled in the art that various changes in form and details may be made therein without departing from the spirit of the invention.

FIG. 1 is a perspective view of a heating body according to an embodiment of the present invention.

Referring to FIG. 1, a heating body 100 includes a tube 110 defining a space for receiving internal parts and a heating member 200 disposed in the tube to emit heat.

The heating body 100 includes a lead rod 150 supporting the heating member 200 without allowing the heat member 200 to contact an inner surface of the tube 110 and a connection member 160 for connecting the lead rod 150 to the heating member 200. In addition, the heating body 100 further includes a metal member 140 connected to a portion of the lead rod 150 to allow an electric conduction between an external power source and the heating member 200 and an insulation member 130 for insulating the metal member 200 from an external side. The heating body 100 further includes a sealing member 120 partly enclosing and supporting the metal member 140, insulation member 130 and tube 110.

In addition, the heating body 100 further includes a supporting unit 300, which prevents the heating member 200 from contacting the inner surface of the tube 110 when the heating member 200 emits heat and thus expands. In this embodiment, the supporting unit 300 includes a first supporting member 310 and a second supporting member 320. The supporting unit 300 will be described later.

The tube 110 functions to not only define the space for receiving the internal parts but also to protect the internal parts. Since the heating body 100 emits heat above hundreds ° C., the tube 110 must be formed of a material having a sufficient rigidity and a sufficient heat-resistance. For example, the tube 110 may be formed of quartz. In addition, the tube 110 must be sealed to isolate the heating member 200 from the external side. Inert gas may be filled in the tube 110 to prevent the heating member 200 from changing in the chemical or physical property.

The heat member 200 emits heat using electric energy applied. The heating member 200 may be formed of a material selected from the group consisting of a carbon-based material, a tungsten-based material, and a nickel/chrome-based alloy.

The connection member 160 includes a plurality of sections connected to opposite ends of the heating member 200. Therefore, the connection member 160 is connected to the lead rod 150 by the connection member 160. Then, the heating member 200 is tensioned not to maintain a state where it does not contact the inner surface of the tube 100. As a result, the heating member 200 can stably emit heat without contacting the tube 100. The lead rod 150 extends up to an external side of the tube 110. Therefore, the sealing state of the tube 110 is maintained and the heating member 200 can be connected to the external power source.

The metal member 140 is connected to the end of the lead rod 150 extending out of the tube 110 to transmit electric energy from the external power source to the heating member 200 via the lead rod 150. Then, the heating member 20 receiving the electric energy emits the heat.

The insulation member 130 insulates an exposed portion of the metal member 140 to an external side to prevent the electric leakage of the metal member 140. The insulation member 130 is designed to be fitted in a product where the heating body 100 will be installed.

The sealing member 120 protects the end portion of the lead rod 150 and the connection portion of the metal member 140 from external impact. The sealing member 120 is assembled with the insulation member 130 and the tube 110 to maintain a predetermined shape of the heating body 100.

FIG. 2 is a sectional view taken along line I-I' of FIG. 1.

Referring to FIG. 2, the heating body 100 includes the tube 110, the heating member 200 disposed in the tube 110, and the connection member 160, the lead rod 150 and metal member 140 that are consecutively connected to the heating member 200. The metal member 140 is insulated by the insulation member 130 and the insulation member 130 and the tube 110 are partly enclosed and supported by the sealing member 120.

In this embodiment, the heating member 200 is coiled by the predetermined number of turns. The supporting unit 300 is arranged extending in a longitudinal direction of the heating member 200. The supporting unit 300 is inserted in the heating member 200 such that it faces the heating member 200 in the longitudinal direction of the heating member 200.

Therefore, the supporting unit 300 supports the heating member 200 with respect to the overall length of the heating member 200. Thus, even when the heating member 200 droops due to its thermal expansion, it still maintains the supporting state by contacting the supporting unit 300. As a result, when the heating member 200 emits the heat, the contact of the heating member 200 with the tube 110 can be prevented.

As described above, the supporting unit 300 includes the first and second supporting members 310 and 320. The first and second supporting members 310 and 320 are symmetrically disposed with respect to the center of the heating member 200. Therefore, even when the heating member 200 thermal-expands, it can be supported by the first and/or second supporting member 310 and/or 320. Therefore, regardless of the drooping direction of the heating member 300, the heating member 300 can be reliably supported by the supporting members 310 and 320. As a result, when the heating member 300 emits the heat, the contact of the heating member 200 with the tube 110 can be more reliably prevented.

Although the supporting unit 300 includes the two supporting members 310 and 320 in this embodiment, the present invention is not limited to this case. That is, the supporting unit 300 may two or more supporting members to more reliably supporting the heating member 200.

FIG. 3 is an enlarged view of a portion A of FIG. 2.

Referring to FIG. 3, the supporting unit 300 and the heating member 200 are spaced apart from each through the overall length of the heating member 200. Therefore, the deformation of the supporting unit 300, which may be caused by an elastic force applied from the heating member 200 to the supporting unit, can be prevented by an elastic force that may be applied to the supporting unit 300, can be prevented. That is, when the supporting unit 300 is deformed by the elastic force, the supporting force of the supporting unit 300 for the heating member 200 may be reduced. However, by the above-described supporting structure, the reduction in the supporting force of the supporting unit 300 can be prevented. Even when the heating member 200 droops by the thermal expansion and thus contacts the supporting unit 300, the elastic force of the heating member 200 is reduced. Thus, the deformation of the supporting unit 300 is very small and the supporting reliability of the supporting unit 300 for the heating member 200 can be enhanced.

FIG. 4 is an enlarged view of a portion B of FIG. 2.

Referring to FIG. 4, a distance d1 is defined between the supporting unit 300 and the metal member 140. Then, since the supporting unit 300 cannot contact the metal member 140 to maintain insulation between them. Therefore, the electric leakage to the heating member 200 by the metal member 140 can be prevented. An end of the supporting unit 300 passes through the tube 110 and is fixed on the sealing member 120, by which the supporting unit 300 has a predetermined supporting force to reliably support the heating member 200.

FIG. 5 is a sectional view taken along line II-II of FIG. 1. Referring to FIG. 5, the heating member 200 is coiled by the predetermined number of turns, the supporting unit 300 is inserted in the heating member 200. A distance d2 is defined between the supporting unit 300 and the heating member 200. Therefore, the electric leakage to the heating member 200 can be prevented, and the supporting unit 300 can reliably support the heating member. The supporting unit 300 can also be fixed on an inner wall of the tube 110. In this case, the supporting force of the supporting unit 300 can be further enhanced to more reliably support the heating member 200.

A heating body according to another embodiment of the present invention will now be described. In this embodiment, the same parts as the foregoing embodiment will not be described.

FIG. 6 is a perspective view of a heating body according to another embodiment of the present invention.

Referring to FIG. 6, a heating body 100 of this embodiment includes a tube 110 and a heating member 201 disposed in the tube 110. The heating member 201 is supportably connected to a lead rod 150 by a connection member 160. A side of the heating member 201 is connected to a metal member 140 for the electric connection with an external power source and enclosed by an insulation member 130. The metal member 140, the insulation member 130 and the tub 110 are partly enclosed and supported by a sealing member 120. The heating member 201 thermally expands during the heat emission. At this point, the contact of the heating member 201 with the tube 110 can be prevented by a supporting unit 300.

In this embodiment, the heating member 201 is formed in a weaved-shape. The supporting unit 300 is coupled to the heating member 201 along a length of the heating member 201 to support the heating member 201. This will be described in more detail later.

FIG. 7 is a sectional view taken along line III-III' of FIG. 6.

Referring to FIG. 7, the heating member 201 is weaved in a cylindrical shape. First and second supporting members 310 and 320 of the supporting unit 300 are coupled to the heating member 201. That is, the first and second supporting members 310 and 320 are spaced apart from each other and inserted in the heating member 201.

Therefore, even when the heating member 201 droops due to the thermal expansion, it can be supported by the supporting unit 300. Therefore, the contact of the heating member 201 with the tube 110 can be prevented during the heat emission.

According to the present invention, since the heating member is supported by the heating unit, the contact of the heating member with the tube can be prevented even when the heating member droops due to the thermal expansion during the heat emission. As a result, the damage of the heating member and the tube can be prevented, thereby increasing the life cycle of the heating body.

In addition, since the supporting unit includes two or more supporting members, the supporting force supporting the heating member can be enhanced, thereby more reliably supporting the heating member.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A heating body comprising:

a tube defining a space for receiving internal parts;

a heating member disposed in the tube, the heating member spaced apart from the tube;

a rod supporting the heating member without allowing the heating member to contact an inner surface of the tube;

a supporting unit inserted in the heating member along a length of the heating member, and including a plurality of supporting members spaced apart from each other at predetermined intervals, the plurality of supporting members spaced apart from the inner surface of the heating member inwardly, respectively; and a sealing member configured to fix ends of the plurality of supporting members on an inner wall of the tube.

2. The heating body according to claim 1, wherein the supporting unit is insulated from a power source connected to the heating member.

3. The heating body according to claim 1, wherein the supporting unit is supported on the tube.

4. The heating body according to claim 3, wherein opposite ends of the supporting unit are elastically coupled to the tube.

5. The heating body according to claim 3, wherein the supporting unit and the tube are sealed together.

6. The heating body according to claim 1, wherein the supporting unit faces the heating member along the length of the heating member.

7. The heating body according to claim 1, wherein the heating member is coiled by the predetermined number of turns and the supporting unit faces and supports the heating member throughout the length of the heating member.

8. The heating body according to 1, wherein the heating member is weaved in a cylindrical shape and the supporting unit is supportably coupled to the heating member along the length of the heating member.

9. The heating body according to claim 1, further comprising a metal member for connecting the heating member to an external power source, wherein the supporting unit and the metal member are insulated from each other.

10. A heating body comprising:

a tube;

a heating member disposed in the tube, the heating member spaced apart from the tube;

a supporting unit inserted in the heating member along a length of the heating member, the supporting unit including a plurality of supporting members spaced apart from an inner surface of the heating member inwardly at a predetermined distance; and a sealing member configured to fix ends of the plurality of supporting members on an inner wall of the tube.

11. The heating body according to claim 10, wherein the end of the supporting unit and the sealing member are sealed together.

12. The heating body according to claim 10, wherein the supporting unit is disposed through the tube.

13. The heating body according to claim 12, wherein the supporting unit and the tube are sealed together.

14. The heating body according to claim 10, the supporting unit includes a plurality of supporting members spaced apart from the tube by a predetermined distance, respectively.

* * * * *